US011749162B2

(12) United States Patent
Kim et al.

(10) Patent No.: US 11,749,162 B2
(45) Date of Patent: Sep. 5, 2023

(54) DISPLAY DEVICE

(71) Applicant: Samsung Display Co., Ltd., Yongin-Si (KR)

(72) Inventors: Kyunho Kim, Yongin-si (KR); Yong-Jin Shin, Asan-si (KR); Joonsuk Baik, Suwon-si (KR); Sung-Mo Yang, Hwaseong-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

(21) Appl. No.: 17/235,141

(22) Filed: Apr. 20, 2021

(65) Prior Publication Data

US 2021/0350737 A1 Nov. 11, 2021

(30) Foreign Application Priority Data

May 6, 2020 (KR) ..... 10-2020-0053789

(51) Int. Cl.
*G09G 3/20* (2006.01)

(52) U.S. Cl.
CPC ... *G09G 3/2003* (2013.01); *G09G 2300/0452* (2013.01)

(58) Field of Classification Search
CPC ..... G09G 3/22; G09G 3/3208; G09G 3/3225; G09G 3/34; G09G 3/2003; G09G 3/3406; G09G 3/3607; G09G 3/3413; G09G 3/342; G09G 2300/0452
See application file for complete search history.

(56) References Cited

U.S. PATENT DOCUMENTS 9,171,491 B1 * 10/2015 Kwon ..... G09G 3/3648
2003/0197799 A1 * 10/2003 Dyas ..... H04N 9/04557 348/E3.018
2011/0141154 A1 * 6/2011 Ahn ..... G09G 3/3426 345/102
2012/0127191 A1 * 5/2012 Choi ..... G09G 3/3648 345/589
2018/0330677 A1 * 11/2018 Guo ..... G09G 3/3607
2020/0105212 A1 * 4/2020 Kim ..... G09G 3/3614

FOREIGN PATENT DOCUMENTS

KR 10-2015-0101512 A 9/2015

* cited by examiner

*Primary Examiner* — Towfiq Elahi
(74) *Attorney, Agent, or Firm* — Innovation Counsel LLP

(57) ABSTRACT

A display device includes a display panel including a first pixel and a second pixel disposed adjacent to the first pixel along a first direction, a gate driver configured to provide gate signals to the display panel, a data driver configured to provide data signals to the first and second pixels and a driving controller configured to receive an image data, configured to provide a data signal to the data driver based on the image data, and configured to determine whether a white balance of a current image data corresponding to the second pixel is within a set range. The driving controller calculates the data voltage provided to the second pixel based on the white balance of the current image data corresponding to the second pixel, a previous image data corresponding to the first pixel, and the current image data.

19 Claims, 4 Drawing Sheets

DISPLAY DEVICE

CROSS-REFERENCE TO RELATED APPLICATION(S)

This application claims priority under 35 USC § 119 to Korean Patent Application No. 10-2020-0053789, filed on May 6, 2020 in the Korean Intellectual Property Office (KIPO), the content of which is incorporated herein in its entirety by reference.

BACKGROUND

1. Field

Embodiments of the present inventive concept relate to a display device, and more particularly to a display device with improved display quality.

2. Description of the Related Art

In general, a display device includes a display panel and a display panel driver. The display panel includes a plurality of gate lines, a plurality of data lines, and a plurality of pixels. The display panel driver includes a gate driver configured to provide a gate signal to the plurality of gate lines, a data driver configured to provide a data signal to the data lines, a driving controller configured to control the gate driver and the data driver, and a power voltage generator configured to provide a power voltage to the display panel.

As the time to charge the pixels of the display panel is shortened, there is a problem in that the pixels cannot be sufficiently charged. Accordingly, the data voltage provided to the pixels may be increased and provided to supplement a charging amount of the pixels.

However, when the increased data is provided to the pixels whose white balance is within a set range, the color coordinates of the pixels may be shifted.

SUMMARY

Some embodiments provide a display device with improved display quality.

According to embodiments, there is provided a display device including a display panel including a first pixel and a second pixel disposed adjacent to the first pixel along a first direction, a gate driver connected to gate lines extending in a second direction perpendicular to the first direction and configured to provide gate signals to the display panel through the gate lines, a data driver connected to data lines extending in the first direction and configured to provide data signals to the first and second pixels through the data lines and a driving controller configured to receive an image data, configured to provide a data signal to the data driver based on the image data, and configured to determine whether a white balance of a current image data corresponding to the second pixel is within a set range. The driving controller calculates the data voltage provided to the second pixel based on the second white balance of the current image data corresponding to the second pixel, a previous image data corresponding to the first pixel, and the current image data.

In embodiments, the driving controller may include an image data analyzer configured to determine whether the white balance of the image data input to the driving controller is within the set range, and configured to select one of a source emphasis enable signal and a source emphasis disable signal and configured to output the selected signal and an image data converter configured to output the data signal based on the image data and the selected signal.

In embodiments, the image data analyzer may provide the source emphasis disable signal when the image data analyzer determines that the white balance of the image data is within the set range.

In embodiments, the image data analyzer may compare the previous image data corresponding to the first pixel and the current image data corresponding to the second pixel when the image data analyzer determines that the white balance of the current image data is not within the set range.

In embodiments, the image data analyzer may provide the source emphasis enable signal to the image data converter when the current image data is larger than the previous image data.

In embodiments, the image data analyzer may provide the source emphasis disable signal to the image data converter when the current image data is less than or equal to the previous image data.

In embodiments, the first pixel may include a first red sub-pixel, a first green sub-pixel, and a first blue sub-pixel, the second pixel may include a second red sub-pixel, a second green sub-pixel, and a second blue sub-pixel, and the image data analyzer may provide the source emphasis disable signal to the image data converter when all of the first red sub-pixel, the second red sub-pixel, the first green sub-pixel, the second green sub-pixel, the first blue sub-pixel, and the second blue sub-pixel are turned on.

In embodiments, the first pixel may include a first red sub-pixel, a first green sub-pixel, and a first blue sub-pixel, the second pixel may include a second red sub-pixel, a second green sub-pixel, and a second blue sub-pixel, and the image data analyzer may compare the previous image data corresponding to the first pixel and the current image data corresponding to the second pixel when the first red sub-pixel and the second red sub-pixel are turned on, and the first green sub-pixel, the first blue sub-pixel, the second green sub-pixel, and the second blue sub-pixel are turned off.

In embodiments, the image data analyzer may provide the source emphasis enable signal to the image data converter when the current image data is larger than the previous image data.

In embodiments, the image data analyzer may provide the source emphasis disable signal to the image data converter when the current image data is less than or equal to the previous image data.

In embodiments, the first pixel may include a first red sub-pixel, a first green sub-pixel, and a first blue sub-pixel, the second pixel may include a second red sub-pixel, a second green sub-pixel, and a second blue sub-pixel, and the image data analyzer may compare the previous image data corresponding to the first pixel and the current image data corresponding to the second pixel when the first blue sub-pixel and the second blue sub-pixel are turned on, and the first green sub-pixel, the first red sub-pixel, the second green sub-pixel, and the second red sub-pixel are turned off.

In embodiments, the image data analyzer may provide the source emphasis enable signal to the image data converter when the current image data is larger than the previous image data.

In embodiments, the image data analyzer may provide the source emphasis disable signal to the image data converter when the current image data is less than or equal to the previous image data.

In embodiments, the first pixel may include a first red sub-pixel, a first green sub-pixel, and a first blue sub-pixel, the second pixel include a second red sub-pixel, a second green sub-pixel, and a second blue sub-pixel, and the image data analyzer may compare the previous image data corresponding to the first pixel and the current image data corresponding to the second pixel when the first green sub-pixel and the second green sub-pixel are turned on, and the first red sub-pixel, the first blue sub-pixel, the second red sub-pixel, and the second blue sub-pixel are turned off.

In embodiments, the image data analyzer may provide the source emphasis enable signal to the image data converter when the current image data is larger than the previous image data.

In embodiments, the image data analyzer may provide the source emphasis disable signal to the image data converter when the current image data is less than or equal to the previous image data.

In embodiments, the first pixel may include a first red sub-pixel, a first green sub-pixel, and a first blue sub-pixel, the second pixel includes a second red sub-pixel, a second green sub-pixel, and a second blue sub-pixel, and the image data analyzer may compare the previous image data corresponding to the first pixel and the current image data corresponding to the second pixel when two selected sub pixels among the first red sub-pixel, the first green sub-pixel, and the first blue sub-pixel in the first pixel are turned on, and two sub pixels in the second pixel which are connected to the same data lines as the two selected sub pixels in the first pixel are turned on.

In embodiments, the image data analyzer may provide the source emphasis enable signal to the image data converter when the current image data is larger than the previous image data.

In embodiments, the image data analyzer may provide the source emphasis disable signal to the image data converter when the current image data is less than or equal to the previous image data.

As described above, the display device according to embodiments of the present inventive concept may include an image data analyzer and an image data converter. The image data analyzer may analyze an image data provided to the display device to determine whether to apply source emphasis.

Accordingly, a value of a data signal output from the image data converter may vary, and a value of a data voltage supplied to the pixels may vary. Accordingly, the display device may prevent color coordinates from being shifted and a luminance may be prevented from deteriorating.

BRIEF DESCRIPTION OF THE DRAWINGS

Illustrative, non-limiting embodiments will be more clearly understood from the following detailed description in conjunction with the accompanying drawings.

DETAILED DESCRIPTION OF THE EMBODIMENTS

Hereinafter, embodiments of the present inventive concept will be explained in detail with reference to the accompanying drawings.

Figure 1:
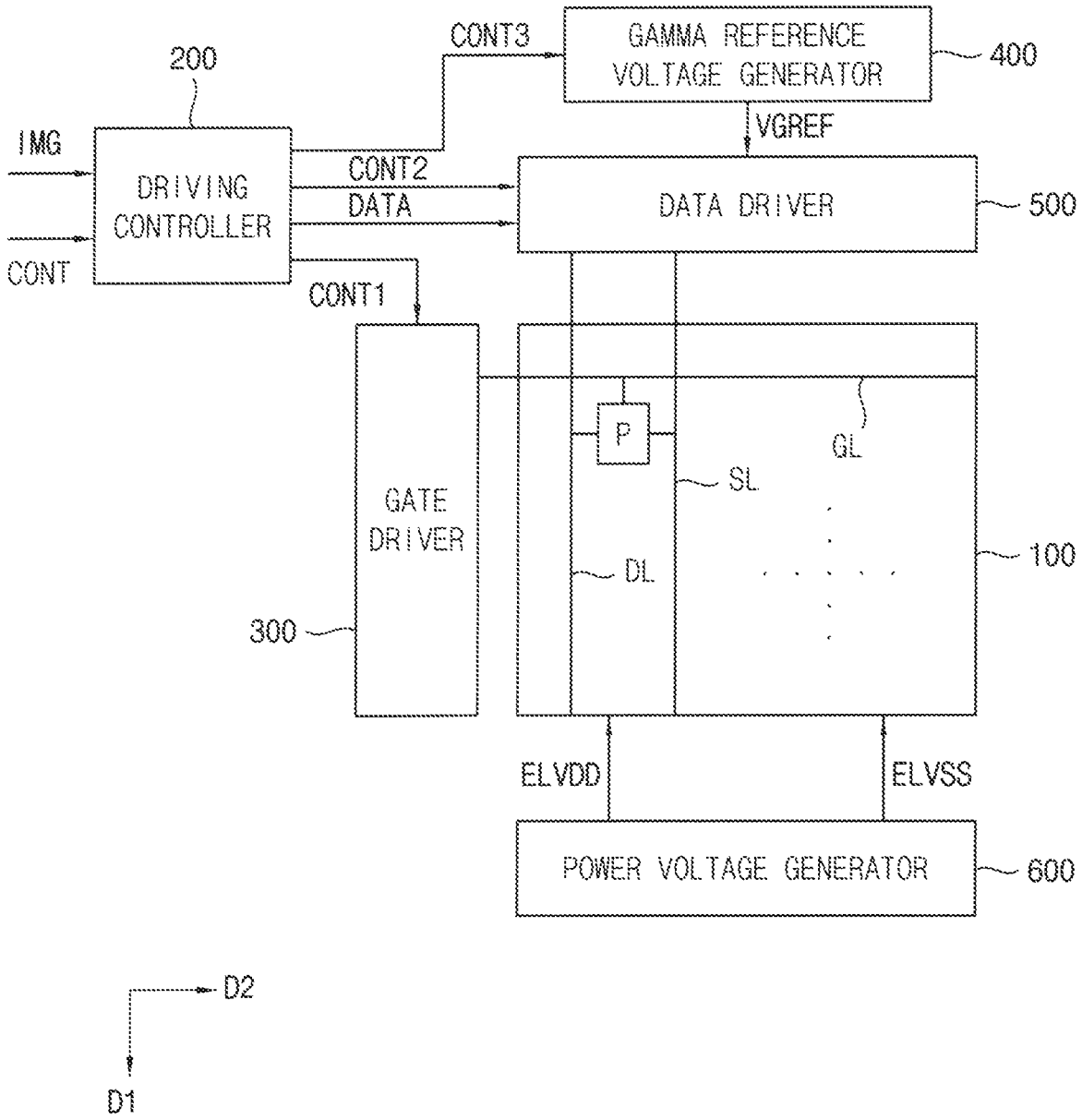
FIG. 1 is a block diagram illustrating a display device according to embodiments.

FIG. 1 is a block diagram illustrating a display device according to embodiments.

Referring to FIG. 1, The display device may include a display panel 100 and a display panel driver. The display panel driver may include a driving controller 200, a gate driver 300, a gamma reference voltage generator 400, and a data driver 500. The display panel driver may further include a power voltage generator 600.

The driving controller 200 and the data driver 500 may be integrally formed in one IC chip. The driving controller 200, the gamma reference voltage generator 400, and the data driver 500 may be integrally formed in one IC chip. A driving module in which the driving controller 200 and the data driver 500 are integrally formed may be referred to as a timing controller embedded data driver ("TED").

The display panel 100 may include a display area displaying an image and a peripheral area disposed adjacent to the display part.

The display panel 100 may include a plurality of gate lines GL, a plurality of data lines DL, and a plurality of pixels P electrically connected to each of the gate lines GL and the data lines DL. The data lines DL may extend in the first direction D1, and the gate lines GL may extend in a second direction D2 perpendicular to the first direction D1. The display panel 100 may further include a plurality of sensing lines SL connected to the plurality of pixels P.

In an embodiment, the display panel 100 may be an organic light emitting display panel including an organic light emitting device. In an embodiment, the display panel 100 may be a liquid crystal display panel including liquid crystal.

The driving controller 200 may receive image data IMG and an input control signal CONT from an external device. The image data IMG may include red image data, green image data, and blue image data. The image data IMG may include white image data. The image data IMG may include magenta image data, yellow image data, and cyan image data. The input control signal CONT may include a master clock signal and a data enable signal. The input control signal CONT may further include a vertical synchronization signal and a horizontal synchronization signal.

The driving controller 200 may generate a first control signal CONT1, a second control signal CONT2, a third control signal CONT3, and a data signal DATA based on the image data IMG and the input control signal CONT.

The driving controller 200 may generate the first control signal CONT1 for controlling the operation of the gate driver 300 based on the input control signal CONT and output the first control signal CONT1 to the gate driver 300. The first control signal CONT1 may include a vertical start signal and a gate clock signal.

The driving controller 200 may generate the second control signal CONT2 for controlling the operation of the data driver 500 based on the input control signal CONT and output the second control signal CONT2 to the data driver 500. The second control signal CONT2 may include a horizontal start signal and a load signal.

The driving controller 200 may generate a data signal DATA based on the image data IMG. The driving controller 200 may output the data signal DATA to the data driver 500.

The driving controller 200 may generate the third control signal CONT3 for controlling the operation of the gamma reference voltage generator 400 based on the input control signal CONT to generate the gamma reference voltage generator 400.

The gate driver 300 may generate the gate signals for driving the pixels P in response to the first control signal CONT1 received from the driving controller 200. The gate driver 300 may output the gate signals to the gate lines GL. For example, the gate driver 300 may sequentially output the gate signals to the gate lines GL. The gate driver 300 may be integrated on the peripheral area of the display panel 100.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF may have a value corresponding to each data signal DATA.

In an embodiment, the gamma reference voltage generator 400 may be disposed in the driving controller 200 or in the data driver 500.

The data driver 500 may receive the second control signal CONT2 and the data signal DATA from the driving controller 200, and may receive the gamma reference voltage VGREF from the gamma reference voltage generator 400. The data driver 500 may convert the data signal DATA into an analog data voltage using the gamma reference voltage VGREF. The data driver 500 may output the data voltage to the data lines DL.

The power voltage generator 600 may generate the power voltage required for driving at least one of the display panel 100, the driving controller 200, the gate driver 300, the gamma reference voltage generator 400, and the data driver 500.

For example, the power voltage generator 600 may generate a first power voltage ELVDD and a second power voltage ELVSS applied to the pixels P of the display panel 100. The power voltage generator 600 may output the first power voltage ELVDD and the second power voltage ELVSS to the display panel 100. The second power voltage ELVSS may be lower than the first power voltage ELVDD.

Figure 2:
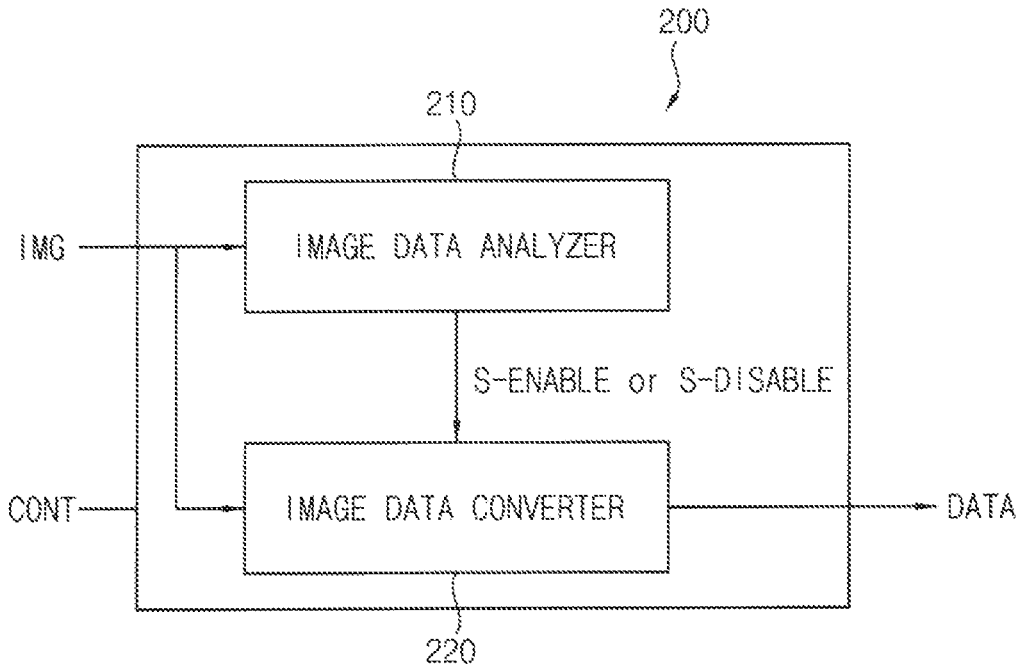
FIG. 2 is a block diagram illustrating a driving controller according to embodiments.

FIG. 2 is a block diagram illustrating a driving controller according to embodiments.

Referring to FIG. 2, the driving controller 200 may include an image data analyzer 210 and an image data converter 220. The driving controller 200 may analyze the image data IMG and determine whether to apply source emphasis to the image data IMG to generate the data signal DATA. In an embodiment, the driving controller 200 may output the data signal DATA which is the image data IMG to which the source emphasis is applied. In an embodiment, the driving controller 200 may output the data signal DATA to the data driver 500 without applying the source emphasis to the image data IMG. When the source emphasis is applied to the image data IMG, the data voltage supplied to the plurality of pixels P may be changed to increase a charging amount of the plurality of pixels P.

In an embodiment, when the current image data for a pixel connected to a current gate line is greater than the previous image data for a pixel connected to a previous gate line, the source emphasis may be executed to the current image data to increase the data signal DATA to have a higher value than a target data signal. In an embodiment, the source emphasis may be executed to decrease the data signal DATA to have a lower value than the target data signal in order to lower the charging rate of the pixel. When the source emphasis is applied, the color coordinates of the plurality of pixels P may be shifted.

In more detail, the image data analyzer 210 may receive the image data IMG from outside of the display panel 100. In an embodiment, when it is determined that the white balance of the image data IMG is within a set range, the image data analyzer 210 transmits a source emphasis disable signal S-DISABLE to the image data converter 220. The image data converter 220 which received the source emphasis disable signal S-DISABLE from the image data analyzer 210 do not perform the source emphasis. In this case, because the source emphasis is not applied, color coordinates of the plurality of pixels P may not be shifted.

In an embodiment, when the image data IMG has a value stored in a gamma lookup table, the image data analyzer 210 may determine that the white balance of the image data IMG is within the set range. In an embodiment, even when the image data IMG has a value within a certain error margin from the value stored in the gamma lookup table, the image data analyzer 210 may determine that the white balance of the image data IMG is within the set range. However, this is exemplary, and a criterion by which the image data analyzer 210 determines that the white balance of the image data IMG is within the set range may not be limited to the examples.

When it is determined that the white balance of the image data IMG is not within the set range, the image data analyzer 210 may transmit a source emphasis enable signal S-ENABLE to the image data converter 220. For example, the image data analyzer 210 may compare the current image data and the previous image data. The image data analyzer 210 may transmit the source emphasis enable signal S-ENALBE to the image data converter 220 when the white balance of the image data is not within the set range and the current image data is greater than the previous image data.

The image data converter 220 may receive the source emphasis enable signal S-ENABLE from the image data analyzer 210 and apply the source emphasis to the image data IMG. The image data converter 220 may not apply the source emphasis to the image data IMG when receiving the source emphasis disable signal S-DISABLE from the image data analyzer 210. Accordingly, the image data converter 220 may output the data signal DATA based on the image data IMG.

The image data converter 220 may transmit the data signal DATA to the data driver 500 of FIG. 1.

When the source emphasis is applied, color coordinates of the plurality of pixels P may be shifted. Accordingly, after determining whether the white balance of the image data IMG is within the set range, the source emphasis may be selectively applied to improve the display quality of the display device.

Figure 3:
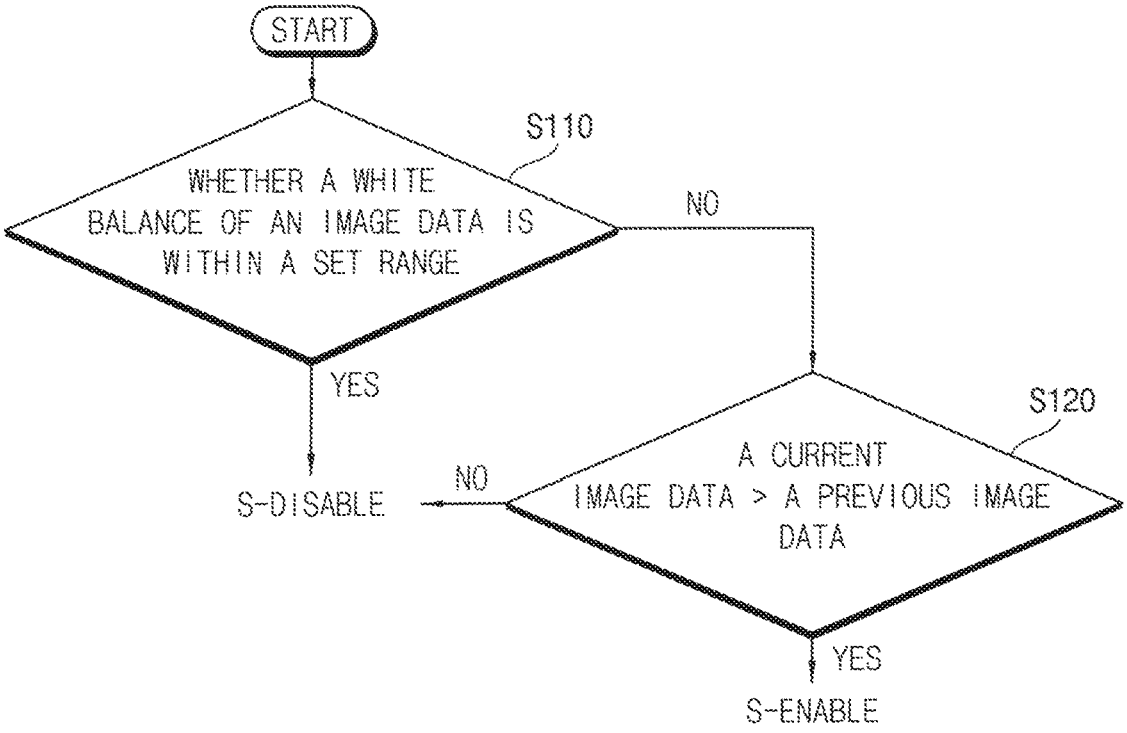
FIG. 3 is a flow chart illustrating a method of determining whether to apply source emphasis according to embodiments.

FIG. 3 is a flow chart illustrating a method of determining whether to apply source emphasis according to embodiments.

Referring to FIGS. 1 to 3, the image data analyzer 210 may determine whether to apply the source emphasis. In an embodiment, the image data analyzer 210 may determine whether the white balance of the image data IMG is within the set range (S110). When it is determined that the white balance of the image data IMG is within the set range, the image data analyzer 210 may not transmit the source emphasis enable signal S-ENABLE to the image data converter 220. Thus the image data converter 220 may not apply the source emphasis to the image data IMG. That is, the image data analyzer 210 may transmit the source emphasis disable signal S-DISABLE to the image data converter 220. Accordingly, since the color coordinates are not shifted, display quality of the display device may be improved.

When it is determined that the white balance of the image data IMG is not within the set range, the image data analyzer 210 may compare a current image data with a previous image data (S120). In an embodiment, when the current image data is larger than the previous image data, the target data voltage may not be provided to the second pixel P2 that is charged based on the current image data. That is, the second pixel P2 may not be charged as much as a desired target. Accordingly, display quality of the display device may be deteriorated. For example, the luminance of the display device may be lowered. Accordingly, the image data converter 220 may output the data signal DATA higher than a target value by applying the source emphasis. Accordingly, it is possible to prevent a decrease in luminance of the display device due to an increase in the data voltage output from the data driver 500.

Figure 4:
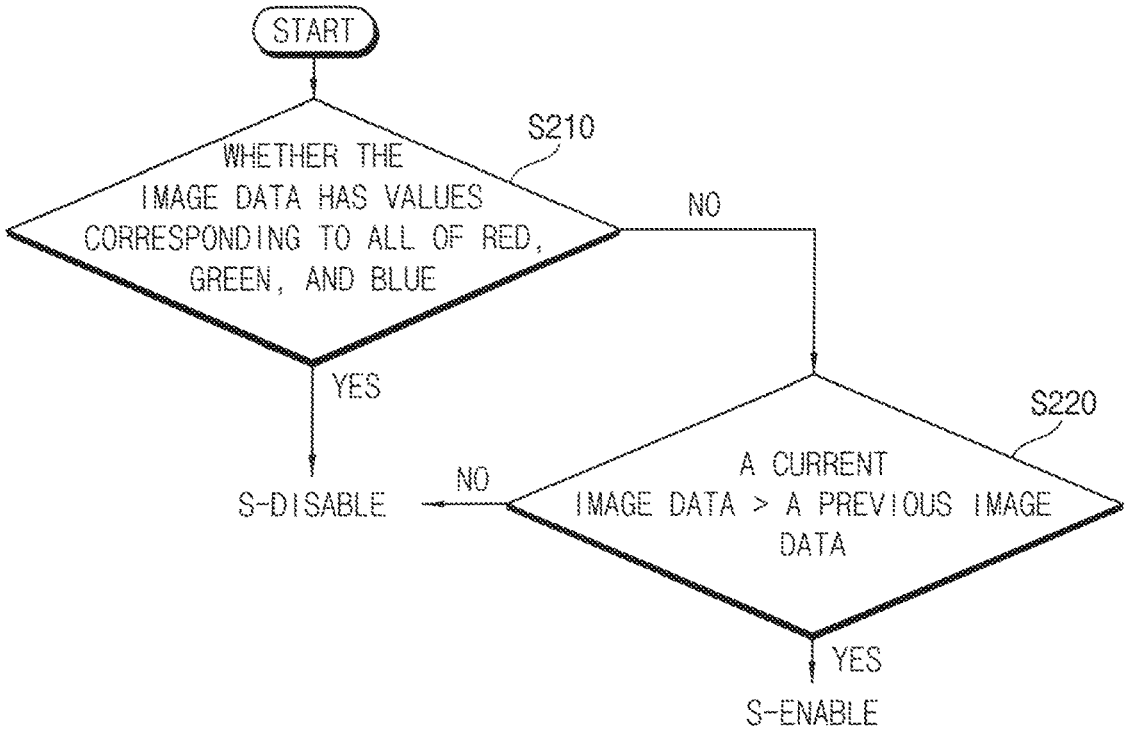
FIG. 4 is a flowchart illustrating a method of determining whether to apply source emphasis according to embodiments.

FIG. 4 is a flowchart illustrating a method of determining whether to apply source emphasis according to embodiments.

Referring to FIGS. 1, 2 and 4, the image data analyzer 210 may determine whether to apply the source emphasis. In an embodiment, the image data analyzer 210 may determine whether the image data IMG for a pixel connected to a current gate line has values corresponding to all of red, green, and blue (S210). When it is determined that the image data IMG includes the red image data, the green image data, and the blue image data at the same time, the image data analyzer 210 may not apply the source emphasis to the image data IMG. That is, the image data analyzer 210 may transmit the source emphasis disable signal S-DISABLE to the image data converter 220. Through this, the color coordinates are not shifted so that the display quality of the display device may be improved.

When it is determined that the image data IMG does not include all of the red image data, the green image data, and the blue image data, the image data analyzer 210 may compare a current image data for a pixel connected to a current gate line and a previous image data for a pixel connected to a previous gate line (S220). When the current image data is larger than the previous image data, the target data voltage may not be provided to the second pixel P2 that is charged based on the current image data. That is, the second pixel P2 may not be charged as much as a desired target. Accordingly, display quality of the display device may be deteriorated. For example, the luminance of the display device may be lowered. Accordingly, the image data converter 220 may output the data signal DATA higher than a target value by applying the source emphasis. Accordingly, it is possible to prevent a decrease in luminance of the display device by increasing the data voltage output from the data driver 500.

Figure 5:
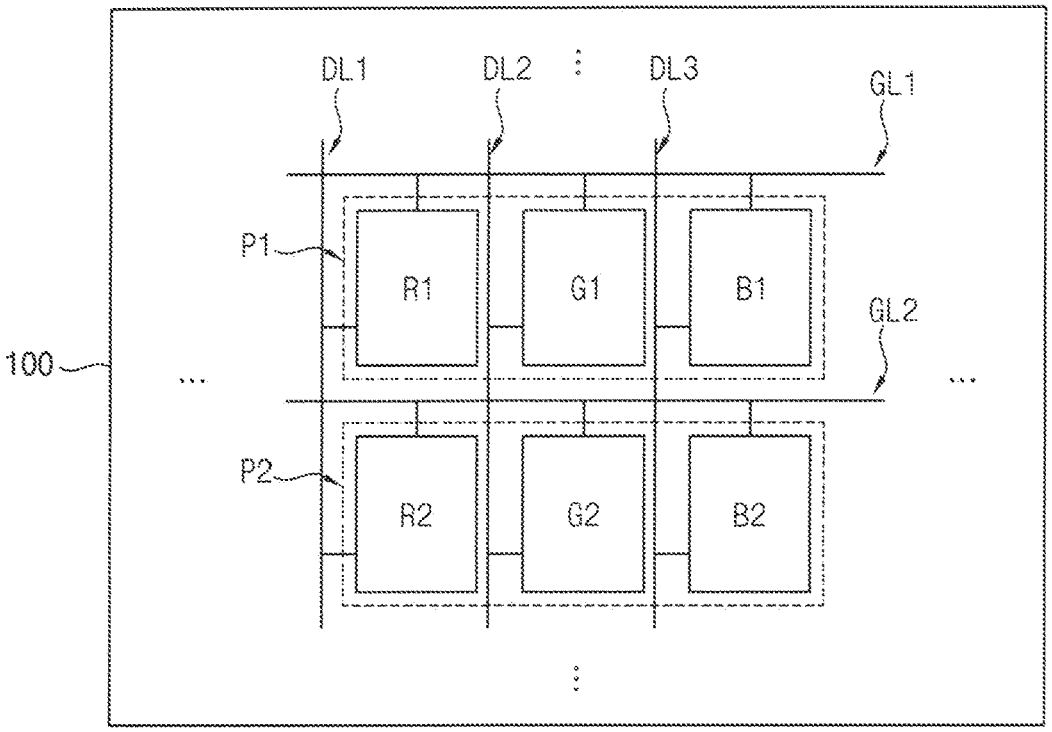
FIG. 5 is a diagram illustrating pixels according to embodiments.

FIG. 5 is a diagram illustrating pixels according to embodiments.

Referring to FIG. 5, the first pixel P1 may include a first red sub-pixel R1, a first green sub-pixel G1, and a first blue sub-pixel B1. The second pixel P2 may include a second red sub-pixel R2, a second green sub-pixel G2, and a second blue sub-pixel B2. The first red sub-pixel R1 and the second red sub-pixel R2 may be connected to a first data line DL1. The first green sub-pixel G1 and the second green sub-pixel G2 may be connected to a second data line DL2. The first blue sub-pixel B1 and the second blue sub-pixel B2 may be connected to a third data line DL3. The first red sub-pixel R1, the first green sub-pixel G1, and the first blue sub-pixel B1 may be connected to a first gate line GL1. The second red sub-pixel R2, the second green sub-pixel G2, and the second blue sub-pixel B2 may be connected to a second gate line GL2.

In an embodiment, the image data analyzer 210 may provide the source emphasis disable signal S-DISABLE to the image data converter 220 when the first red sub-pixel R1, the second red sub-pixel R2, the first green sub-pixel G1, the second green sub-pixel G2, the first blue sub-pixel B1, and the second blue sub-pixel B2 are all turned on.

In an embodiment, when the sub-pixel is turned on, it means that the gray scale of the sub-pixel exceeds 0, and when the sub-pixel is turned off, it may mean that the gray scale of the sub-pixel is 0. However, this is exemplary, and the meaning that the sub-pixel is turned on is not limited thereto. For example, when the gray scale of the sub-pixel connected to the current gate line is higher than the sub-pixel connected to the previous gate line, it may be defined that the sub-pixel is turned on.

In an embodiment, when the first red sub-pixel R1 and the second red sub-pixel R2 are turned on, and the first green sub-pixel G1, the second green sub-pixel G2, the first blue sub-pixel B1, and the second blue sub-pixel B2 are turned off, the image data analyzer 210 may compare the previous image data corresponding to the first pixel P1 with the current image data corresponding to the second pixel P2. When the current image data is larger than the previous image data, the source emphasis enable signal S-ENABLE may be provided to the image data converter 220. When the current image data is less than or equal to the previous image data, the source emphasis disable signal S-DISABLE may be provided to the image data converter 220.

In an embodiment, when the first blue sub-pixel B1 and the second blue sub-pixel B2 are turned on, and the first green sub-pixel G1, the second green sub-pixel G2, the first red sub-pixel R1, and the second red sub-pixel R2 are turned off, the image data analyzer 210 may compare the previous image data corresponding to the first pixel P1 with the current image data corresponding to the second pixel P2. When the current image data is larger than the previous image data, the source emphasis enable signal S-ENABLE may be provided to the image data converter 220. When the current image data is less than or equal to the previous image data, the source emphasis disable signal S-DISABLE may be provided to the image data converter 220.

In an embodiment, when the first green sub-pixel G1 and the second green sub-pixel G2 are turned on, and the first blue sub-pixel B1, the second blue sub-pixel B2, the first red sub-pixel R1, and the second red sub-pixel R2 are turned off, the image data analyzer 210 may compare the previous image data corresponding to the first pixel P1 with the current image data corresponding to the second pixel P2. When the current image data is larger than the previous image data, the source emphasis enable signal S-ENABLE may be provided to the image data converter 220. When the current image data is less than or equal to the previous image data, the source emphasis disable signal S-DISABLE may be provided to the image data converter 220.

In an embodiment, the image data analyzer 210 may compares the previous image data corresponding to the first pixel P1 and the current image data corresponding to the second pixel P2 when two selected sub pixels among the first red sub-pixel R1, the first green sub-pixel G1, and the first blue sub-pixel B1 in the first pixel P1 are turned on, and two sub pixels in the second pixel P2 which are connected to the same data lines as the two selected sub pixels in the first pixel P1 are turned on. When the current image data is larger than the previous image data, the source emphasis enable signal S-ENABLE may be provided to the image data converter 220. When the current image data is less than or equal to the previous image data, the source emphasis disable signal S-DISABLE may be provided to the image data converter 220.

Figure 6:
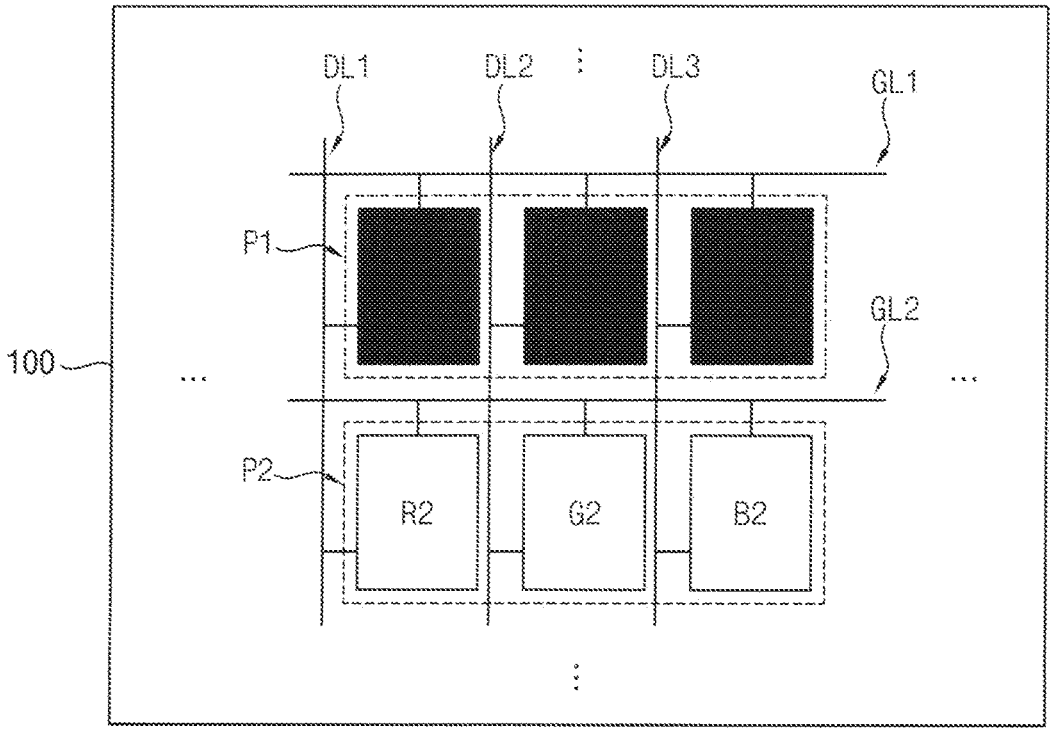
FIG. 6 is a diagram illustrating pixels according to embodiments.

FIG. 6 is a diagram illustrating pixels according to embodiments.

Referring to FIG. 6, the first pixel P1 may express a dark color. For example, the first pixel P1 may represent black. A first data voltage may be applied to the first pixel P1. The second pixel P2 may represent a relatively brighter color than the first pixel P1. For example, the second pixel P2 may represent gray or white. A second data voltage higher than the first data voltage may be applied to the second pixel P2. As the second data voltage is applied after the first data voltage is applied, the second pixel P2 may not be charged by a desired amount. In order to prevent this, the second data voltage may be increased and output by applying the source emphasis to the image data IMG corresponding to the second data voltage. For example, when the first data voltage is 1V and the second data voltage is 5V, the second pixel P2 may be charged only up to 4.8V. To prevent this, the second data voltage may be output as 5.2V by applying the source emphasis to charge the second pixel P2 to 5V.

Accordingly, the display device according to the present inventive concept may prevent the color coordinates of the plurality of pixels P from being shifted and may prevent the luminance of the plurality of pixels P from being lowered.

The inventive concepts may be applied to any display device, and a method of operating the display device. For example, the inventive concepts may be applied to a mobile phone, a smart phone, a tablet computer, a wearable electronic device, a virtual reality ("VR") device, a television ("TV"), a digital TV, a 3D TV, a personal computer ("PC"), a home appliance, a laptop computer, a personal digital assistant ("PDA"), a portable multimedia player ("PMP"), a digital camera, a music player, a portable game console, a navigation device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A display device comprising:

a display panel including a plurality of pixels arranged in a plurality of columns extending along a first direction and a plurality of rows extending along a second direction crossing the first direction, the plurality of pixels including a first pixel disposed in a first column and a first row, and a second pixel disposed in the first column and a second row;

a gate driver connected to gate lines extending in the second direction and configured to provide gate signals to the display panel through the gate lines;

a data driver connected to data lines extending in the first direction, the data driver being and configured to provide data signals to the first pixel and the second pixels pixel through a corresponding data line; and a driving controller configured to receive an image data, configured to provide a data signal to the data driver based on the image data, and configured to determine whether a white balance of a current row image data corresponding to the second pixel is within a set range by comparing the current row image data corresponding to the second pixel and an image data corresponding to the second pixel stored in a gamma lookup table, wherein the driving controller calculates the data voltage provided to the second pixel based on the white balance of the current row image data corresponding to the second pixel, a previous row image data corresponding to the first pixel, and the current row image data corresponding to the second pixel.

2. The display device of claim 1, wherein the driving controller includes:

an image data analyzer configured to determine whether the white balance of the image data input to the driving controller is within the set range and configured to select one of a source emphasis enable signal and a source emphasis disable signal and configured to output the selected signal; and an image data converter configured to output the data signal based on the image data and the selected signal.

3. The display device of claim 2, wherein the image data analyzer provides the source emphasis disable signal when the image data analyzer determines that the white balance of the image data is within the set range.

4. The display device of claim 2, wherein the image data analyzer compares the previous row image data corresponding to the first pixel and the current row image data corresponding to the second pixel when the image data analyzer determines that the white balance of the current row image data is not within the set range.

5. The display device of claim 4, wherein the image data analyzer provides the source emphasis enable signal to the image data converter when the current row image data is larger than the previous row image data.

6. The display device of claim 4, wherein the image data analyzer provides the source emphasis disable signal to the image data converter when the current row image data is less than or equal to the previous row image data.

7. The display device of claim 2, wherein the first pixel includes a first red sub-pixel, a first green sub-pixel, and a first blue sub-pixel, wherein the second pixel includes a second red sub-pixel, a second green sub-pixel, and a second blue sub-pixel, and wherein the image data analyzer provides the source emphasis disable signal to the image data converter when all of the first red sub-pixel, the second red sub-pixel, the first green sub-pixel, the second green sub-pixel, the first blue sub-pixel, and the second blue sub-pixel are turned on.

8. The display device of claim 2, wherein the first pixel includes a first red sub-pixel, a first green sub-pixel, and a first blue sub-pixel, wherein the second pixel includes a second red sub-pixel, a second green sub-pixel, and a second blue sub-pixel, and wherein the image data analyzer compares the previous row image data corresponding to the first pixel and the current row image data corresponding to the second pixel when the first red sub-pixel and the second red sub-pixel are turned on, and the first green sub-pixel, the first blue sub-pixel, the second green sub-pixel, and the second blue sub-pixel are turned off.

9. The display device of claim 8, wherein the image data analyzer provides the source emphasis enable signal to the image data converter when the current row image data corresponding to the second pixel is larger than the previous row image data corresponding to the first pixel.

10. The display device of claim 8, wherein the image data analyzer provides the source emphasis disable signal to the image data converter when the current row image data corresponding to the second pixel is less than or equal to the previous row image data corresponding to the second pixel.

11. The display device of claim 2, wherein the first pixel includes a first red sub-pixel, a first green sub-pixel, and a first blue sub-pixel, wherein the second pixel includes a second red sub-pixel, a second green sub-pixel, and a second blue sub-pixel, and wherein the image data analyzer compares the previous row image data corresponding to the first pixel and the current row image data corresponding to the second pixel when the first blue sub-pixel and the second blue sub-pixel are turned on, and the first green sub-pixel, the first red sub-pixel, the second green sub-pixel, and the second red sub-pixel are turned off.

12. The display device of claim 11, wherein the image data analyzer provides the source emphasis enable signal to the image data converter when the current row image data corresponding to the second pixel is larger than the previous row image data corresponding to the first pixel.

13. The display device of claim 11, wherein the image data analyzer provides the source emphasis disable signal to the image data converter when the current row image data corresponding to the second pixel is less than or equal to the previous row image data corresponding to the first pixel.

14. The display device of claim 2, wherein the first pixel includes a first red sub-pixel, a first green sub-pixel, and a first blue sub-pixel, wherein the second pixel includes a second red sub-pixel, a second green sub-pixel, and a second blue sub-pixel, and wherein the image data analyzer compares the previous row image data corresponding to the first pixel and the current row image data corresponding to the second pixel when the first green sub-pixel and the second green sub-pixel are turned on, and the first red sub-pixel, the first blue sub-pixel, the second red sub-pixel, and the second blue sub-pixel are turned off.

15. The display device of claim 14, wherein the image data analyzer provides the source emphasis enable signal to the image data converter when the current row image data corresponding to the second pixel is larger than the previous row image data corresponding to the first pixel.

16. The display device of claim 14, wherein the image data analyzer provides the source emphasis disable signal to the image data converter when the current row image data corresponding to the second pixel is less than or equal to the previous row image data corresponding to the first pixel.

17. The display device of claim 2, wherein the first pixel includes a first red sub-pixel, a first green sub-pixel, and a first blue sub-pixel, wherein the second pixel includes a second red sub-pixel, a second green sub-pixel, and a second blue sub-pixel, and wherein the image data analyzer compares the previous row image data corresponding to the first pixel and the current row image data corresponding to the second pixel when two selected sub pixels among the first red sub-pixel, the first green sub-pixel, and the first blue sub-pixel in the first pixel are turned on, and two sub pixels in the second pixel which are connected to the same data lines as the two selected sub pixels in the first pixel are turned on.

18. The display device of claim 17, wherein the image data analyzer provides the source emphasis enable signal to the image data converter when the current row image data corresponding to the second pixel is larger than the previous row image data corresponding to the first pixel.

19. The display device of claim 17, wherein the image data analyzer provides the source emphasis disable signal to the image data converter when the current row image data corresponding to the second pixel is less than or equal to the previous row image data corresponding to the first pixel.

* * * * *